US005794297A

United States Patent [19]

Muta

[11] Patent Number: 5,794,297

[45] Date of Patent: Aug. 18, 1998

[54] CLEANING MEMBERS FOR CLEANING AREAS NEAR WALLS USED IN FLOOR CLEANER

[75] Inventor: Kouichi Muta, Chiba, Japan

[73] Assignee: Hoky Contico, L.L.C., St. Louis, Mo.

[21] Appl. No.: 412,451

[22] Filed: Mar. 29, 1995

[30] Foreign Application Priority Data

Mar. 31, 1994 [JP] Japan ..... 6-085690

[51] Int. Cl.[6] ..... A47L 11/33; A47L 13/00

[52] U.S. Cl. ..... 15/42; 15/41.1; 15/45; 15/52.1

[58] Field of Search ..... 15/41.1, 42, 47, 15/43, 44, 45, 46, 48, 48.1, 48.2, 93.1, 49.1, 50.3, 52.1, 83

[56] References Cited

U.S. PATENT DOCUMENTS

| | | | |
|---|---|---|---|
| 1,949,659 | 3/1934 | Ritter | 15/44 |
| 2,994,098 | 8/1961 | Fukuba . | |
| 3,748,679 | 7/1973 | Rosendall . | |
| 3,766,588 | 10/1973 | Kipecky | 15/47 |
| 4,007,508 | 2/1977 | Ooyachi | 15/42 |
| 4,099,284 | 7/1978 | Shinozaki et al. . | |
| 4,815,157 | 3/1989 | Tsuchiya | 15/42 |
| 4,845,797 | 7/1989 | Kobayashi | 15/41.1 |

FOREIGN PATENT DOCUMENTS

| | | | |
|---|---|---|---|
| 0251174 | 4/1926 | United Kingdom | 15/41.1 |

*Primary Examiner*—David Scherbel
*Assistant Examiner*—Randall Chin
*Attorney, Agent, or Firm*—Howell & Haferkamp, L.C.

[57] ABSTRACT

A cleaning member having reduced manufacturing cost is provided for effectively sweeping out fine dust, pieces of thread, pieces of cotton waste and the like, and otherwise improving dust collecting performance. The cleaning members for cleaning areas nearby walls are fitted to a floor cleaner that stirs up dust on the surface of a floor by means of a rotary member mounted on its main body casing. The floor cleaner receives and contains the stirred-up dust in dust collecting chambers. The cleaning member includes a mounting section which is molded integrally from a soft and flexible material and which is for mounting the cleaning member onto the main body casing, and at least one downwardly extending plate.

37 Claims, 17 Drawing Sheets

FIG. 8
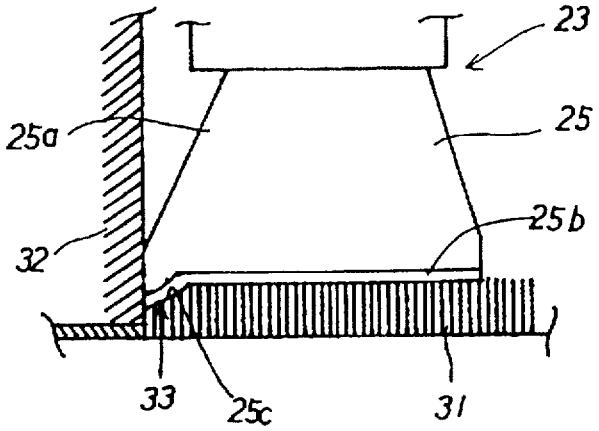
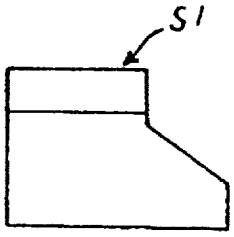
FIG. 9(a)
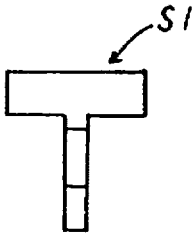
FIG. 9(b)
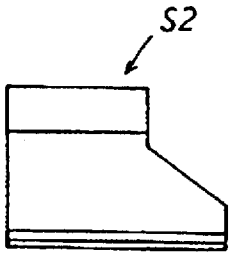
FIG. 10(a)
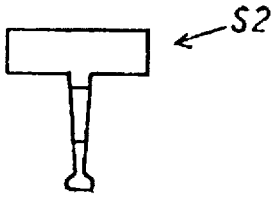
FIG. 10(b)

FIG. 20

| Sample / Test Item | Bread Crumbs (2g) | | Sands (2g) | |
|---|---|---|---|---|
| | Amount of Transfer (g) | Ratio of Transfer (%) | Amount of Transfer (g) | Ratio of Transfer (%) |
| Conventional Type Cleaning Member | 0.82 | 41.17 | 0.97 | 48.87 |
| Typical Embodiment | 1.00 | 50.00 | 1.17 | 58.83 |
| Sample S1 Embodiment | 1.18 | 59.50 | 0.58 | 29.33 |
| Sample S2 Embodiment | 1.36 | 68.17 | 0.46 | 23.00 |
| Sample S3 Embodiment | 1.11 | 55.83 | 0.62 | 31.33 |
| Sample S4 Embodiment | 1.58 | 76.83 | 1.48 | 74.00 |
| Sample S5 Embodiment | 1.65 | 77.50 | 0.59 | 94.83 |

FIG. 21

Measurement of Operating Force (g) in Movement on Floor Surface

| | Flooring | Punch Carpet | 7 m/m Cut Pile Carpet | 15 m/m Pile Carpet |
|---|---|---|---|---|
| Conventional Type Cleaning Member | 300 | 600 | 1350 | 1900 |
| Typical Embodiment | 150 | 450 | 1300 | 1500 |
| Sample S1 Embodiment | 200 | 300 | 1150 | 2400 |
| Sample S2 Embodiment | 150 | 600 | 1700 | 2350 |
| Sample S3 Embodiment | 150 | 500 | 2000 | 3200 |
| Sample S4 Embodiment | 200 | 500 | 2000 | 3200 |
| Sample S5 Embodiment | 500 | 2250 | 2600 | 3800 |

FIG. 23

Evaluation of Cleaning Results: 1 Good ↕ 5 Poor

| Test Floor | Material of Cleaning Member for Cleaning Areas near Walls / Profile of Cleaning Member for Cleaning Areas near Walls / Sample | Brush furnished with Bristles | Soft and Flexible Material (Downwardly Extending Plate) | | | |
|---|---|---|---|---|---|---|
| | | Conventional Type | Typical Embodiment | Sample Embodiment | | Downwardly Extending Plate having Reduced Height in the Typical Embodiment |
| | | | | S 8 | S 9 | |
| Carpet 15 m/m | Bread Crumbs | 3 | 2 | 4 | 5 | 1 |
| | Sand | 2 | 1 | 5 | 4 | 3 |
| Carpet 7 m/m | Bread Crumbs | 3 | 1 | 5 | 4 | 2 |
| | Sand | 3 | 2 | 4 | 5 | 1 |
| Needle Punch | Bread Crumbs | 1 | 2 | 5 | 4 | 3 |
| | Sand | – | – | – | – | – |
| Flooring Floor | Bread Crumbs | 3 | 1 | 4 | 2 | 5 |
| | Sand | 2 | 1 | 4 | 3 | 5 |

※ Equivalent evaluations were obtained for each profile of cleaning members for cleaning areas near walls in the case in which test floor was "needle punch" and the sample was "sands", respectively.

PRIOR ART

CLEANING MEMBERS FOR CLEANING AREAS NEAR WALLS USED IN FLOOR CLEANER

BACKGROUND OF THE INVENTION

1. Field of the Invention

The present invention relates to a cleaning member fitted to a floor cleaner which cleans areas nearby walls. The cleaning member is mounted rotatably on a main body casing of the floor cleaner and stirs up dust and the like on the surface of a floor. The dust and the like stirred up by the cleaning member is received and contained in dust collecting chambers of the cleaner.

2. Description of the Related Art

A typical prior art floor cleaner is shown in FIG. 24. The cleaner includes a rotary cleaning member 2 disposed at a central portion at the bottom of a main body casing 1. Dust collecting chambers 3 and 4 are located closely to the front and rear sides of the rotary cleaning member 2, respectively. Driving wheels 6 and 7 are disposed at the forward and the rearward positions of the main body casing 1 and engage in driving contact with driven wheels 5, 5 fixed to opposite ends of the rotary cleaning member 2, respectively. In such a floor cleaner, when the main body casing 1 is moved forwardly and backwardly through a handle 8 attached to the top wall of the main body casing 1 by an operator's action, the driving wheels 6 and 7 rotate, and then the rotary cleaning member 2 rotates in response to the rotation of the driving wheels 6 and 7. The rotation of the cleaning member 2 stirs up the dust on the surface of a floor and the dust is received by and contained in the dust collecting chambers 3 and 4 of the body casing.

Furthermore, as disclosed in U.S. Pat. Nos. 3,748,679 and 4,099,284, such floor cleaners have employed cleaning members for cleaning areas nearby walls. These cleaning members have been positioned at the corners of its main body casing as auxiliary brushes, whereby the cleaning of dust in areas nearby walls, corner areas of a room, besides peripheral areas around a desk, furniture and the like can be effectively carried out.

However, conventional cleaning members for cleaning areas nearby walls disposed at the corners of a main body casing are typically prepared by planting horse's hair or resin fibers onto a plate-like pedestal, or intertwining a prescribed brush hair with steel wires, so that fine dust particles may pass through gaps defined between brush hairs, resulting in incomplete scraping out of the dust in areas nearby walls. Furthermore, such a conventional cleaning member often merely smoothes down the dust on the surface of the floor by the force applied by the cleaning member, so that the cleaning member rides across the dust, and as a result the dust remains on the floor. Moreover, pieces of thread or bits of cotton often become intertwined with the brush hairs due to static electricity produced when the brush hairs rub on the surface of a floor, defeating the essential purpose of the brush hairs in providing a sweeping-out effect. Also, manufacturing a conventional cleaning member for cleaning areas nearby walls in extremely complicated in that horse's hair or resin fibers are planted onto a plate-like pedestal, thereby resulting in high manufacturing cost.

OBJECTS AND SUMMARY OF THE INVENTION

The present invention has been made in view of the problems involved in the prior art. Principal objects of the present invention are to provide a cleaning member fitted to a floor cleaner to thereby improve the cleaning of areas near walls, to eliminate the risk of twining of pieces of cotton or similar waste such as pieces of thread, bits of cotton and the like with the cleaning member and thereby improve the dust collecting performance, and further to reduce manufacturing cost of the cleaning member.

In order to attain the above described objects the cleaning member for cleaning areas near walls according to the present invention includes a mounting section for mounting the cleaning member onto a main body casing. The body member is molded integrally from a soft and flexible material. The cleaning member also includes at least one downwardly extending plate. Cleaning members are mounted on the main body casing of a floor cleaner which receives and contains the dust removed from the floor by a rotating member in dust collecting chambers of the cleaner.

Since the cleaning member according to the present invention is integrally molded from a soft and flexible material, the sweeping-out effect in areas near walls can be remarkably increased. The problem of decreasing dust collection performance caused by twisting or twining pieces of cotton or similar waste such as pieces of thread, bits of cotton and the like with the extreme end portion of a downwardly extending plate included in the cleaning member are solved. In addition, manufacturing cost can be reduced, since the manufacturing process is simplified.

BRIEF DESCRIPTION OF THE DRAWINGS

The present invention will become more fully understood from the detailed description given hereinbelow and the accompanying drawings which are given by way of illustration only, and not to limit the present invention, wherein:

FIG. 8 is an explanatory view showing a cleaning state of a groove-like area defined by the standing point of a piece of furniture and a carpet laid on the bottom thereof.

FIGS. 9(*a*) and (*b*) are, respectively, a front view and a side view showing the profile of a cleaning member sample S1.

FIGS. 10(*a*) and (*b*) are, respectively, a front view and a side view showing the profile of a cleaning member sample S2.

FIG. 20 is a Table showing measured results for the amount and the ratio of transfer of two dust samples for cleaning members of a conventional type, the typical embodiment, and sample S1 through S5 embodiments according to the present invention, each attached to a floor cleaner.

FIG. 21 is a Table showing measured operating forces in moving floor cleaners over a variety of flooring materials. Results are shown for floor cleaners having attached cleaning members of a conventional type, the typical embodiment, and sample S1 through S5 embodiments according to the present invention.

FIG. 23 is a Table showing the results of cleaning the area defined by the measuring condition illustrated in FIG. 19. The results are evaluated into five ranks by visual observation and rankings for various cleaning members for cleaning areas nearby walls are shown.

DETAILED DESCRIPTION OF THE PREFERRED EMBODIMENTS

Figure 1:
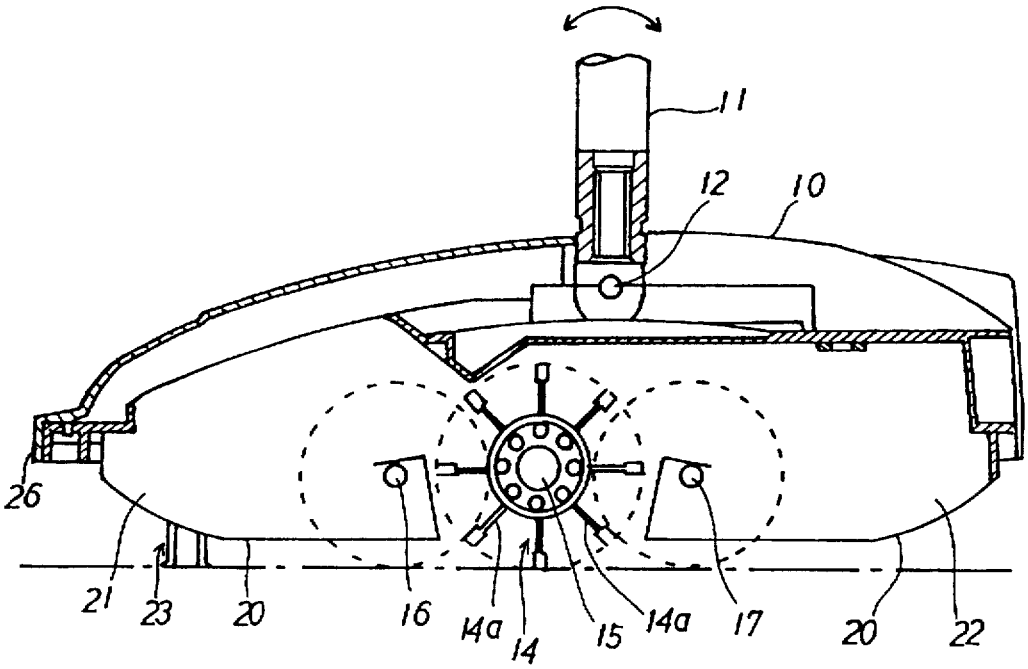
FIG. 1 is a longitudinal sectional view showing a floor cleaner provided with the cleaning members for cleaning areas nearby walls according to an embodiment of the present invention.
Figure 2:
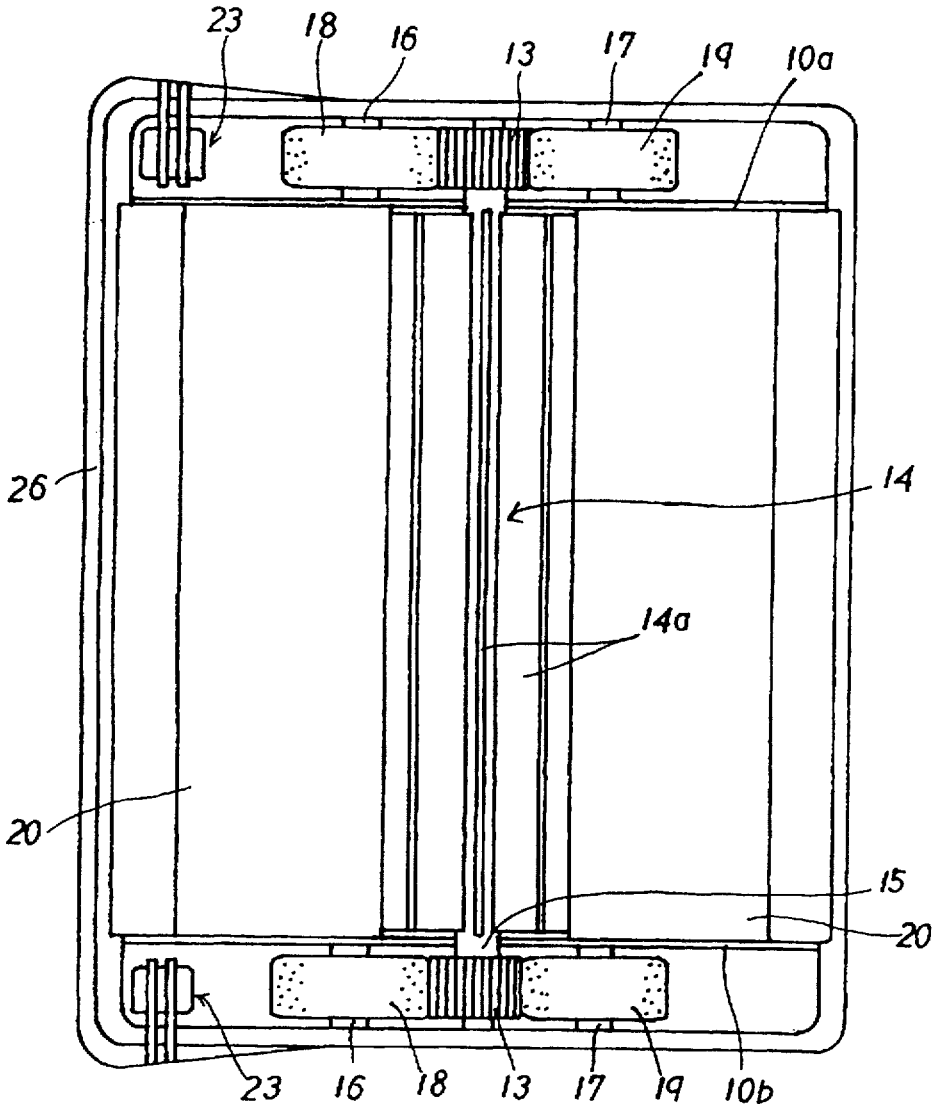
FIG. 2 is a bottom view of the floor cleaner shown in FIG. 1.
Figure 3:
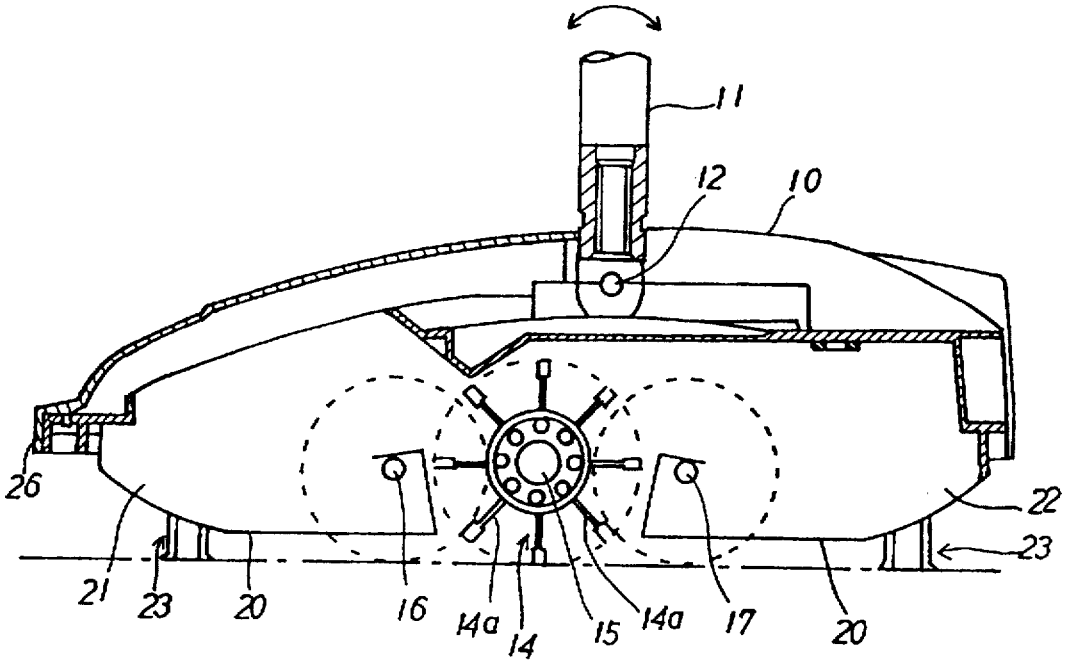
FIG. 3 is a longitudinal sectional view illustrating a modification of the floor cleaner shown in FIG. 1.
Figure 4:
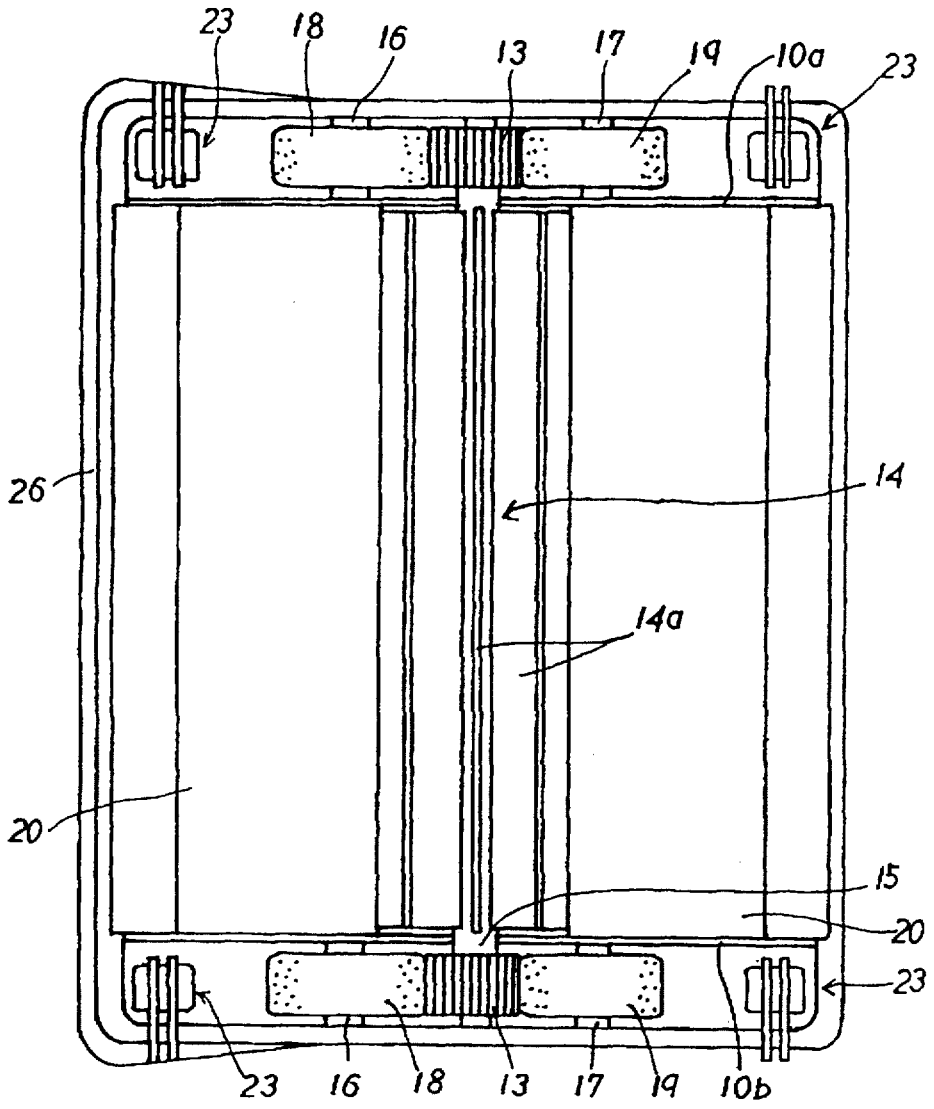
FIG. 4 is a bottom view of the floor cleaner shown in FIG. 3.

Embodiments of a cleaning member for cleaning areas nearby walls used in the floor cleaner according to the present invention will be described hereinbelow. FIG. 1 is a longitudinal sectional view showing an embodiment of the floor cleaner provided with cleaning members for cleaning areas nearby walls according to the present invention. FIG. 2 is a bottom end view of the floor cleaner shown in FIG. 1. FIGS. 3 and 4 illustrate a modification of the floor cleaner shown in FIGS. 1 and 2, respectively. The floor cleaner shown in FIGS. 1 and 2 is different from that of FIGS. 3 and 4 merely in the number of the cleaning members 23 for cleaning areas near walls that are mounted on a main body casing 10, but the other components are common to both the floor cleaners. More specifically, the floor cleaner shown in FIGS. 1 and 2 includes two cleaning members 23 at opposite corners of the front end of the main body casing 10, while the floor cleaner shown in FIGS. 3 and 4 includes four cleaning members 23 at the four corners of the main body casing 10.

In FIGS. 1 through 4, a connecting part 12 is mounted on top of the central portion of main body casing 10. A handle 11 is connected to connecting part 12, which itself is rotatable along the front and rear directions of the floor cleaner. The bottom of main body casing 10 is opened in a rectangular shape. Inside the main body casing 10, a pair of driven wheels 13 are disposed at opposite side ends in the middle portion of the casing 10, and a rotating shaft 15 is mounted between opposing side plates 10*a* and 10*b* in the middle portion of the main body casing 10. A rotary cleaning member 14 is provided around rotating shaft 15 and the rotating shaft is mounted so that the lower part of the rotary cleaning member 14 always protrudes from the casing 10.

Shafts 16 and 17 are, respectively, in front and in back of rotating shaft 15 and are parallel thereto. Shafts 16 and 17 are disposed between the opposite side ends of the main body casing 10 with a pair of driving wheels 18 fitted to shaft 16 and a pair of driving wheels 19 fitted to shaft 17 in such a manner that pairs of driving wheels 18 and 19 are in forcible contact with a driven wheel 13, and the lower parts of both pairs of driving wheels 18 and 19 protrude from an opening section of the main body casing 10.

A pair of plates 20 extend between side plates 10*a* and 10*b* in the front and rear side sections of the main body casing 10 in a substantially horizontal state along the opening section of the bottom of the main body casing 10 so as to cover the opening section. An upwardly bent portion of each of the pair of plates 20 facing rotary cleaning member 14 and suitably spaced therefrom defines a respective dust collecting chamber 21 or 22. The dust collecting chambers 21 and 22 are assembled so as to be openable downwards at the fulcrums on both the front and rear sides of the main body casing 10, respectively.

The rotary cleaning member 14 is composed of a plurality of blades 14*a* each having one end fixed to the circumference of the rotating shaft 15 in parallel to the axial direction of shaft 15 so as to allow the other end of each blade 14*a* to diverge radially from the rotating shaft 15. The blade 14*a* is made of a resilient elastic sheet such as a rubber sheet, a synthetic resin sheet, a metallic spring sheet or the like. Blade 14*a* is to be sufficiently bent when the blade comes in contact with a floor surface.

To effectively clean areas nearby walls in a room or areas around household furniture or furnishings, cleaning members 23 are attached to the corners on the bottom of the main body casing 10 of the floor cleaner. Each cleaning member 23 is integrally made from a flexible, soft material such as rubber, resin, or a similar material.

Figure 5C:
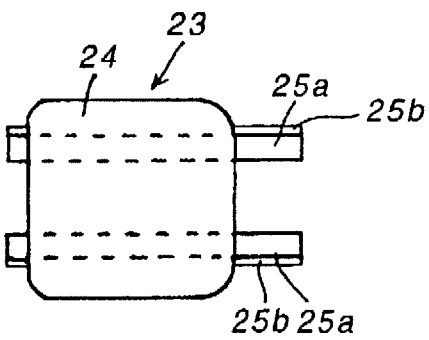
FIGS. 5(*a*), (*b*) and (*c*) are explanatory views each showing a basic profile of a cleaning member for cleaning areas nearby walls.
Figure 5B:
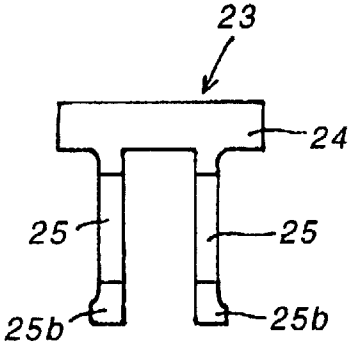
Figure 5A:
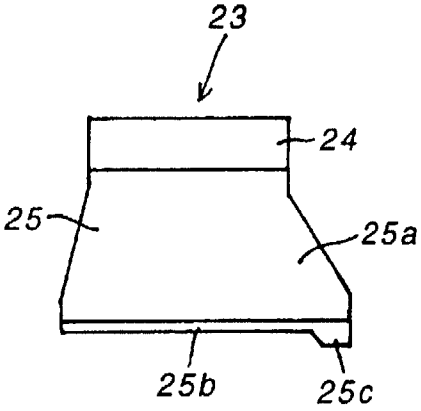

The basic profile of the cleaning member 23 is shown in FIGS. 5(*a*), (*b*) and (*c*). Cleaning member 23 is composed of a plate-like mounting section 24 for mounting the entire cleaning member 23 on the main body casing 10 and two parallel thin, downwardly extending plates 25, which are integrally formed with the lower parts of the mounting section 24 while keeping a prescribed spacing between them. The cleaning member 23 for cleaning areas near walls are fitted to the main body casing 10 so that the thin, downwardly extending plates 25 are parallel to the axial direction of the rotating shaft 15 (the direction perpendicular to the moving direction of the floor cleaner). Furthermore, one side end of each of the downwardly extending plates 25 is formed into an overhang 25*a* which projects outwardly from the side of the main body casing 10.

Moreover, a thickened extension 25*b* somewhat thicker than a thickness of the downwardly extending plates is formed over the whole length of the lowest edge on the side of each of the thin cleaning pieces 25 facing to the outside. In addition, a protruding portion 25*c* protrudes downwardly form the lowest extreme end portion of the overhang 25*a* of each of the downwardly extending plates 25.

A shock-absorbing band 26 made of a strip-like elastic material is attached to at least the front and forward side opposite end portions of the circumference of the main body casing 10 for cushioning the shock that occurs when the main body casing 10 collides with a wall surface during cleaning operation.

Cleaning with the floor cleaner described above is accomplished as follows: First, the main body casing 10 is placed on the surface of a floor with the projecting lower portions of both pairs of driving wheels 18 and 19 contacting the floor surface. The contact of the pairs of driving wheels 18 and 19 with the floor surface does not interfere with rotary cleaning member 14, since the blades 14*a* of rotary cleaning member 14 that are in contact with the floor surface are bent. When the main body casing 10 is moved forward and backward on the floor surface by an operator using handle 11, the pairs of driving wheels 18 and 19 roll on the floor surface, and at the same time the rotary cleaning member 14 also rolls because the pair of driven wheels 13 are in forcible contact with respective ones of the pairs of driving wheels 18 and 19. Dust and the like on the surface of a floor is stirred up by the turning force of rotary cleaning member 14 and the elastic force accumulated and released from the forcible bending and release of blades 14*a*. The stirred-up material is contained by the dust collecting chambers 21 and 22. Waste such as pieces of thread, bits of cotton and the like are neither held by the extreme end portions of the blades 14*a* which had been in contact with the floor surface, nor is winding or twining of such waste observed on the rotary cleaning member 14.

Figure 6:
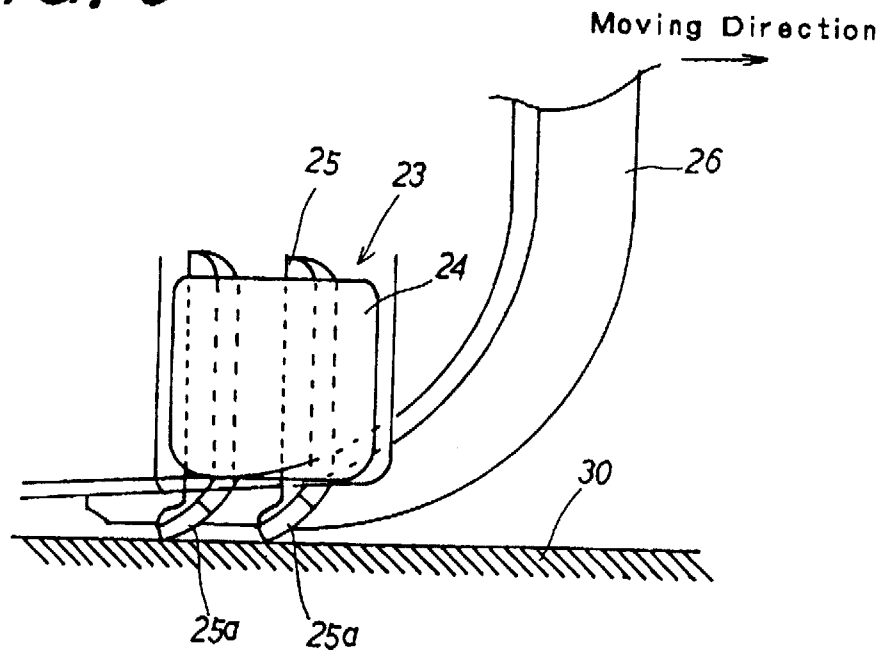
FIG. 6 is a top explanatory view showing a state wherein a floor cleaner is operated while keeping it in contact with a wall.

Cleaning members 23, each of which is integrally molded from a soft material having flexibility such as rubber, resin or a similar substance are mounted on the main body casing 10 of the cleaner at the corners thereof. When the main body casing 10 is moved forward and backward while frictionally rubbing the floor surface in a substantially horizontal direction with keeping a side of the main body casing 10 in contact with a wall 30 as shown in FIG. 6, dust 30 near a wall 30 is scraped out by cleaning members 23, and the dust so scraped out is easily swept up by the rotary cleaning member 14 and received and collected in the dust collecting chambers 21 and 22.

When the main body casing 10 is moved forward and backward, dust which had been left as a result of sweeping up by the forward-positioned downwardly extending plates 25 of cleaning members 23 is swept together by the other rearward-positioned downwardly extending plates 25. Accordingly, the cleaning effect is improved because there is no case in which dust is left after completing the cleaning operation.

Figure 7:
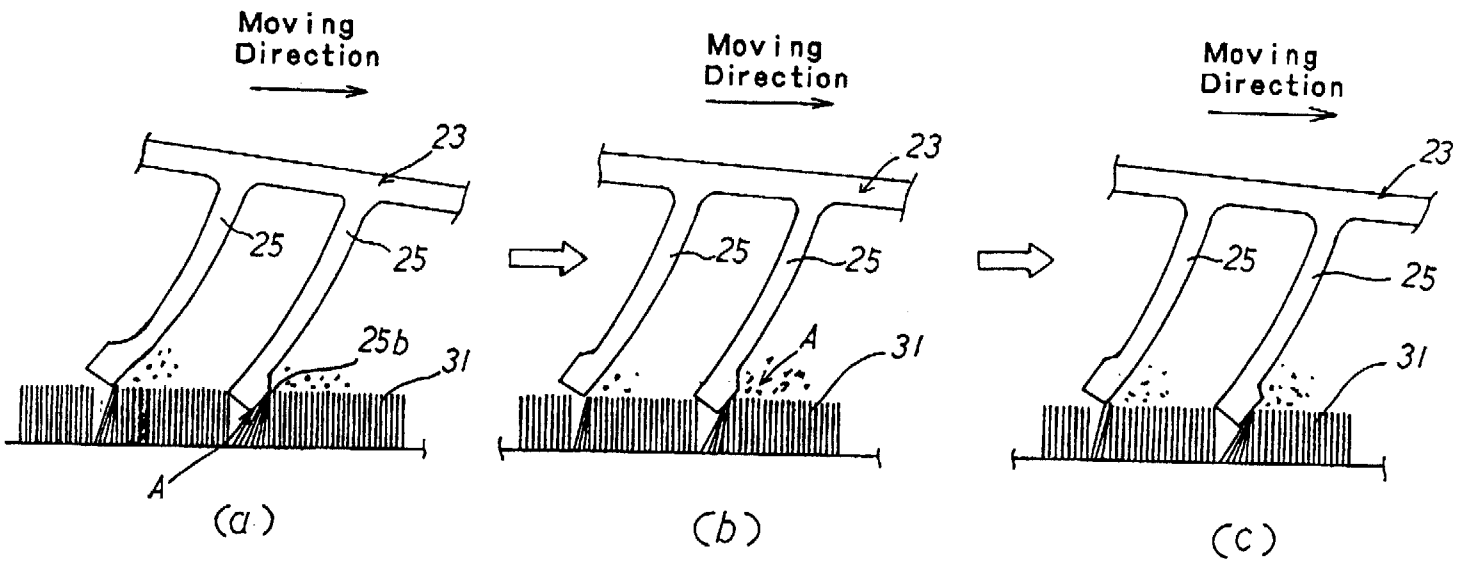
FIGS. 7(*a*), (*b*) and (*c*) are explanatory views each showing a state wherein dust is scraped up by a cleaning member for cleaning areas near walls of the present invention.
Figure 11A:
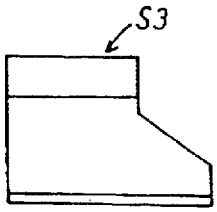
FIGS. 11(*a*) and (*b*) are, respectively, a front view and a side view showing the profile of a cleaning member sample S3.
Figure 11B:
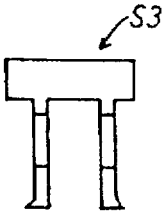
Figure 12A:
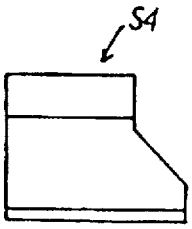
FIGS. 12(*a*) and (*b*) are, respectively, a front view and a side view showing the profile of a cleaning member sample S4.
Figure 12B:
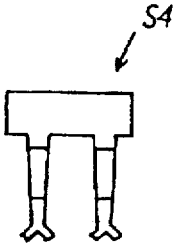
Figure 13A:
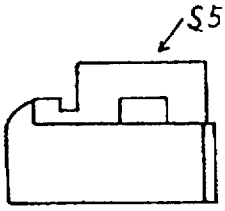
FIGS. 13(*a*), (*b*) and (*c*) are, respectively, a front view, a bottom view and a side view showing the profile of a cleaning member sample S5.
Figure 13B:
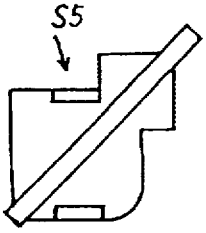
Figure 13C:
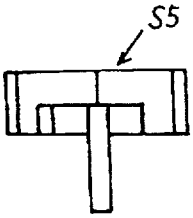
Figure 14A:
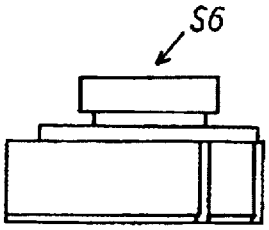
FIGS. 14(*a*), (*b*) and (*c*) are, respectively, a front view, a bottom view and a side view showing the profile of a cleaning member sample S6.
Figure 14B:
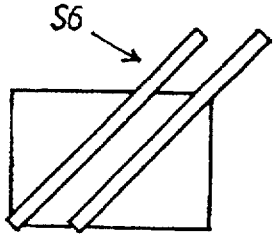
Figure 14C:
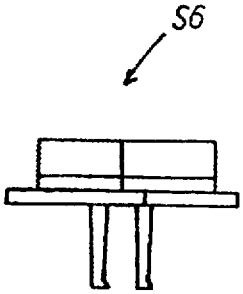
Figure 15:
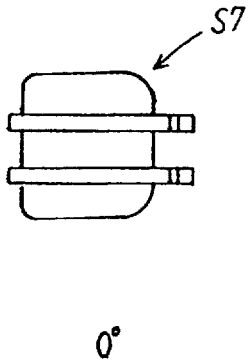
FIG. 15 is a bottom view showing a cleaning member sample S7 attached to a floor cleaner so that surfaces of two parallel downwardly extending plates are parallel to the axial direction of a rotary member.
Figure 16:
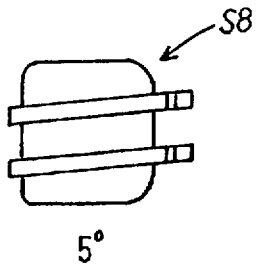
FIG. 16 is a bottom view showing a cleaning member sample S8 attached to a floor cleaner so that surfaces of two parallel downwardly extending plates are inclined at 5° with respect to the axial direction of a rotary cleaning member.
Figure 17:
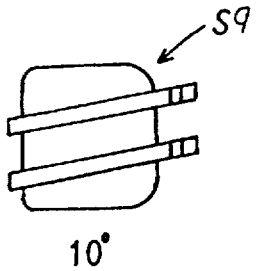
FIG. 17 is a bottom view showing a cleaning member sample S9 attached to a floor cleaner so that surfaces of two parallel downwardly extending plates are inclined at 10° with respect to the axial direction of a rotary cleaning member.
Figure 18:
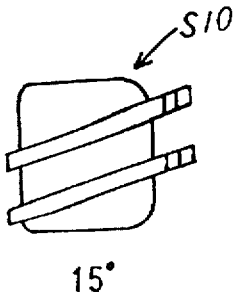
FIG. 18 is a bottom view showing a cleaning member sample S10 attached to a floor cleaner so that surfaces of two parallel downwardly extending plates are inclined at 15° with respect to the axial direction of a rotary cleaning member.

More specifically, referring to FIGS. 7(*a*)–(*c*) the dust A existing in carpet 31 is taken up by the thickened extension 25*b* formed on the forward side of one of the forward-positioned downwardly extending plates 25 and the dust thus taken up is transferred forwardly along the moving direction by the other, rearward-positioned downwardly extending plate 25 so that much more dust can be transferred along the moving direction thereof.

Cleaning member 23 also utilizes overhang 25*a*, which extends sidewards from the main body casing 10 and forms a protruding portion 25*c* on the lower part of the overhang at the extreme end thereof. As shown in FIG. 8, when a piece of furniture 32 rests on a long-haired carpet 31, a groove-like area appears on the carpet 31 at the contacting point of the furniture 32 due to the weight thereof. Protruding portion 25*c* of the cleaning member 23 gets into the groove-like area 33 so that the dust therein can effectively be scraped out by cleaning member 23 with its improved profile.

Cleaning member 23 is integrally molded from a soft and flexible material such as rubber, resin or a similar material, so that the extreme end portion of the thin, downwardly extending plate 25 of the cleaning member 23 does not become twisted or twined with waste such as pieces or bits of cotton or the like. Moreover manufacturing of cleaning member 23 can be simplified to reduce the manufacturing cost thereof. The profile of cleaning member 23, particularly the portion in contact with the surface of the floor, can freely be selected, also.

Although the cleaning member 23 is composed of the mounting section 24 and two parallel downwardly extending plates 25 molded integrally with the mounting section having a prescribed spacing between them, the number of the thin cleaning sheets is not limited; one or three or more sheets may be utilized.

While thin, downwardly extending plates 25 of cleaning member 23 are fitted to the main body casing 10 so that the surfaces of the downwardly extending plates 25 are parallel to the axial direction of the rotary cleaning member 14 in the present embodiment, downwardly extending plates 25 disposed at the right and left corners of the main body casing 10 may alternatively be inclined inwardly with respect to the moving direction of the floor cleaner, so that the dust scraped out by the downwardly extending plates 25 is collected at the central portion of rotary cleaning member 14.

Moreover, while thickened extension 25*b* is formed over the whole length of the lowest outside-facing edge of downwardly extending plate 25, thickened extension 25*b* may alternatively formed on both sides of downwardly extending plate 25.

Embodiments thus far explained have shown cleaning members 23 disposed only at both the corners in the front edge of the main body casing 10 (FIGS. 1 and 2) or at four corners of the main body casing 10 (FIGS. 3 and 4). However, cleaning members 23 may alternatively be disposed only at both the rear corners in the rear edge of the main body casing 10.

Cleaning members 23 may be detachably fitted to the main body casing 10 so that the cleaning members are easily replaceable in case of deterioration with age.

Comparative measurements of the amount of dust transferred and operating force used with cleaning members according to the present invention versus conventional cleaning members provided with brush hair are described below.

The different configurations used for the comparative measurements are: a floor cleaner having conventional brush-hair cleaning members attached at each of its four corners (referred to as "conventional type floor cleaner"); a floor cleaner with cleaning members according to the present invention having the basic profile shown in FIG. 5 mounted at both the opposite corners of the front edges of the floor cleaner (referred to as "the typical embodiment of the floor cleaner according to the present invention," FIG. 1); and floor cleaners on which are mounted various modified cleaning members in accordance with the present invention having a variety of profiles (i.e. samples S1 through S10, inclusive, shown in FIGS. 9 through 18) at both opposite corners of the front edges of each of the floor cleaners (referred to as "sample S1 through sample S10 embodiments of the floor cleaners according to the present invention", respectively).

An operating force (g) applied to the above described cleaning members attached to each floor cleaner was measured with respect to flooring, punch carpet, 7 mm cut pile carpet, and 15 mm cut pile carpet.

In order to measure the amount of dust transferred, 2 grams of bread crumbs or sands are used as samples for dust. Each sample is scattered on a 7 mm cut pile carpet in a strip-shaped layer having 20 mm width and 500 mm length in an area near a wall as shown in FIG. 19, and an amount of the sample transferred (g) and a ratio of transfer (%) of the sample are measured for the variety of cleaning members in the case in which a floor cleaner is moved repeatedly in a certain direction five times up to a position 50 mm ahead form the front-most end of the sample layer to be measured.

Figure 19:
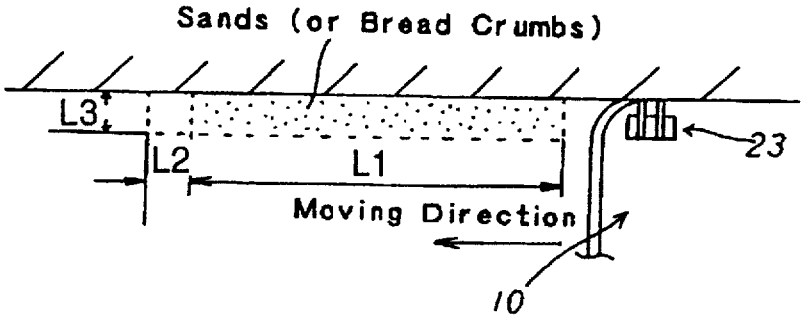
FIG. 19 is an explanatory view illustrating a measuring condition in which an amount of dust transferred is measured for floor cleaners to which cleaning members having a variety of profiles according to the present invention are attached.
Figure 22:
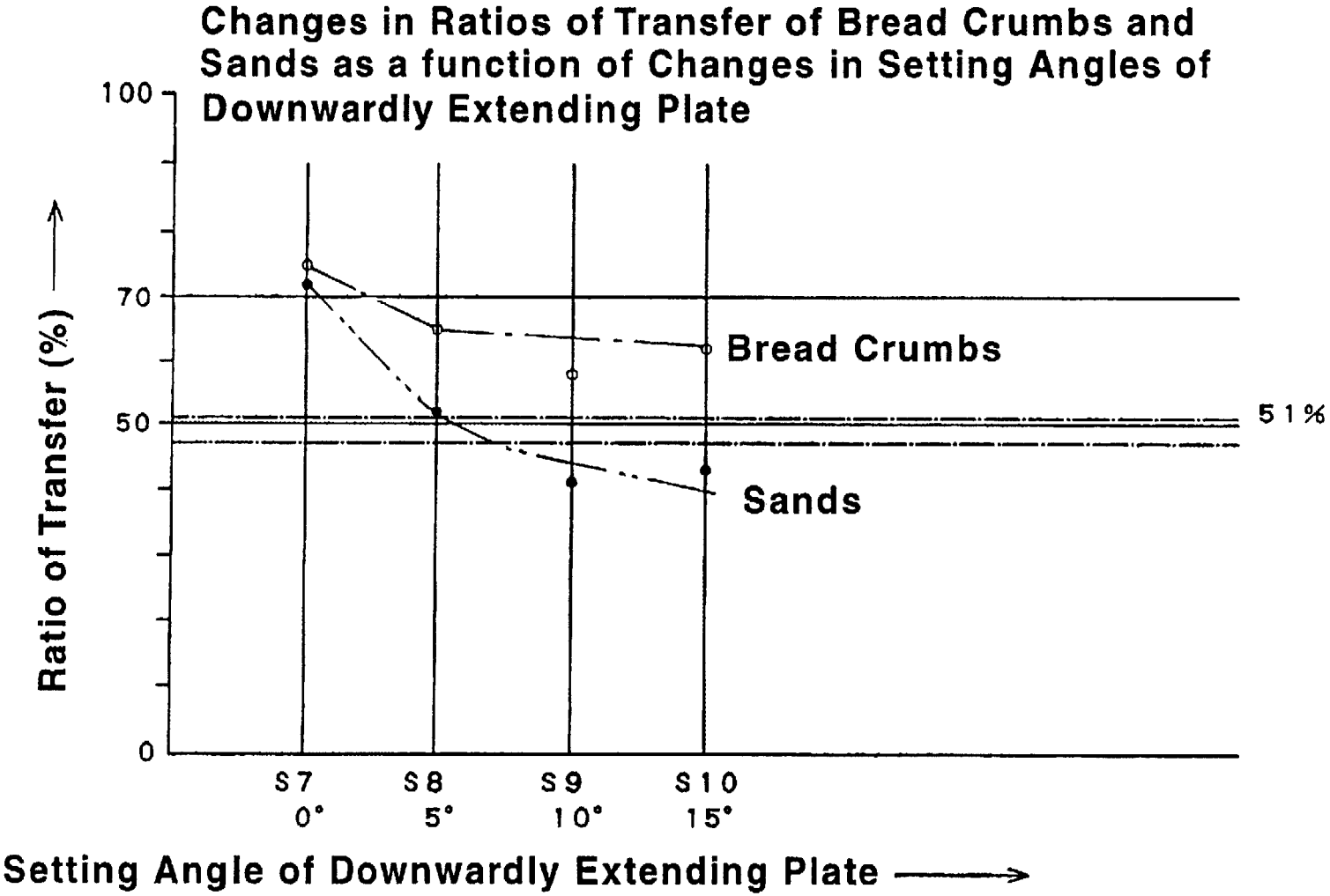
FIG. 22 is a graphical representation of the relationship between the ratio of dust samples transferred and the setting angle of downwardly extending plate for floor cleaners having sample S7 through S10 cleaning member embodiments according to the present invention.
Figure 24:
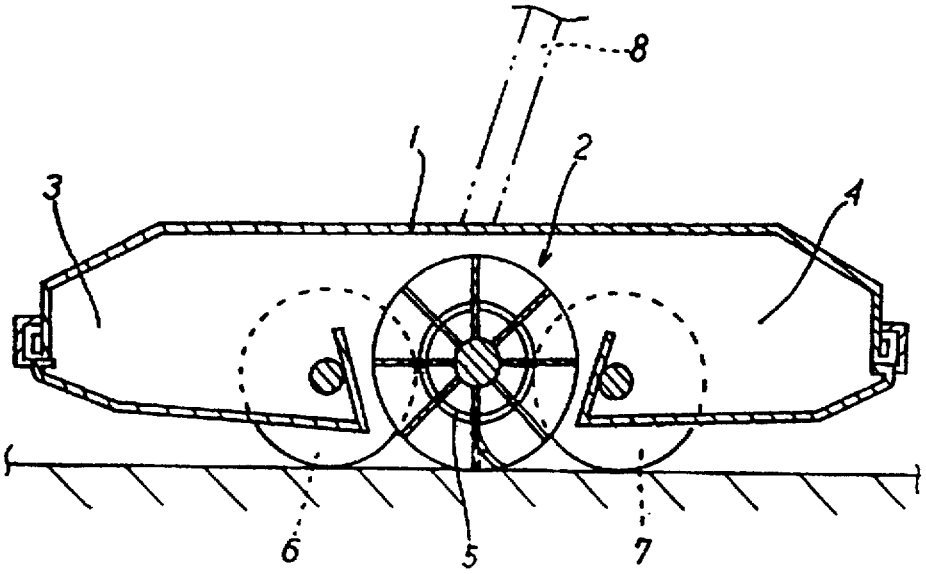
FIG. 24 is a sectional view showing the main parts of a conventional floor cleaner.

FIG. 20 is a Table showing the amount of sample transferred (g) and the ratio of transfer (%) of the samples in floor cleaners to which are attached cleaning members of a conventional type, the typical embodiment, and sample S1 through sample S5 embodiments, in accordance with the measuring conditions illustrated in FIG. 19; FIG. 21 is a Table indicating the operating force in the movement of floor cleaners to which are attached cleaning members of a conventional type, the typical embodiment, and sample S1 through sample S5 embodiments with respect to surfaces of various floors; FIG. 22 is a graphical representation showing the relationship between the ratio of transfer of samples and the setting angle of the downwardly extending plates in sample S7 through sample S10 embodiments; and FIG. 23 is a Table showing results of cleaning the area on which had been scattered each of the samples, each area having been cleaned in accordance with the measuring conditions illustrated in FIG. 19, in which L1=500 mm, L2=50 mm and L3=20 mm. The cleaning results in FIG. 23 were evaluated in five ranks by visual observation.

From the results of the measurements, it has been found that a longer downwardly extending plate is turned over in the area near a wall, leaving sample dust therein. Also a comparatively thickened one-piece downwardly extending plate requires a comparatively large operating force to scatter dust rearwards and upwardly, and two comparatively thicker downwardly extending plates exhibit a tendency to leave dust near a wall when the main body casing leaves the wall. On the other hand, when two downwardly extending plates as shown in the typical embodiment of the present invention are employed, each having a short length and an overhang facing the wall, there is no rearward and upward scattering of dust due to mutual interaction of the two downwardly extending plates so that effective cleaning of the area on which sample dust had been scattered could be attained.

It will be appreciated by those of ordinary skill in the art that the present invention can be embodied in other specific forms without departing form the spirit or essential characteristics thereof.

The presently disclosed embodiments are therefore considered in all respects to be illustrative and not restrictive. The scope of the invention is indicated by the appended claims rather than the foregoing description, and all changes that come with the meaning and range of equivalents thereof are intended to be embraced therein.

What is claimed is:

1. A plurality of cleaning members for cleaning areas near walls and fitted to a floor cleaner that stirs up dust and the like on a surface of a floor by means of a rotary member mounted on a main body casing of the floor cleaner, thereby to receive and contain the dust and the like thus stirred up in dust collecting chambers, each of said cleaning members comprising:

a mounting section for mounting the cleaning member onto said main body casing; and a plate extending downwardly from said mounting section and having a top edge joined to said mounting section, the mounting section and the plate being integrally molded from a soft and flexible material;

wherein said cleaning members are located on said main body casing so that at least one of said downwardly extending plates thereof extends along a direction perpendicular to a moving direction of said floor cleaner, and said downwardly extending plate includes an overhang along the direction perpendicular to the moving direction of said floor cleaner and projecting outwardly from said main body casing, and a protruding portion protruding downwardly from a lower end of said overhang.

2. The plurality of cleaning members of claim 1, wherein each of said cleaning members includes one of said downwardly extending plates, each of said downwardly extending plates having a surface, the surface having a lowermost edge on which is formed, over its whole length, a thickened extension.

3. The plurality of cleaning members of claim 1, wherein each of said cleaning members contains two of said downwardly extending plates, a first of said downwardly extending plates having a front surface positioned forwardly with respect to a moving direction of said floor cleaner, said front surface having a lowermost edge having a thickened extension formed over a whole length thereof, and a second of said downwardly extending plates having a rear surface positioned rearwardly with respect to said moving direction of said floor cleaner, said rear surface having a lowermost edge having a thickened extension formed over a whole length thereof.

4. A cleaning member for cleaning areas near walls and fitted to a floor cleaner that stirs up dust and the like on a surface of a floor by means of a rotary member mounted on a main body casing of the floor cleaner, thereby to receive and contain the dust and the like thus stirred up in dust collecting chambers, said cleaning member comprising:

a mounting section for mounting the cleaning member onto said main body casing; and a plate extending downwardly from said mounting section, and having a top edge joined to said mounting section;

the mounting section and the plate being integrally molded from a soft and flexible material;

wherein said downwardly extending plate includes an overhang having a lower end said overhang extending along a direction perpendicular to a moving direction of said floor cleaner and projecting downwardly from said main body casing, said overhang also having a protruding portion protruding downwardly from said lower end of said overhang.

5. A cleaning member for cleaning areas near walls and for attachment to a floor cleaner, the floor cleaner having a main body casing including a bottom, the cleaning member comprising:

a top mounting section for mounting the cleaning member onto a corner of the bottom of the main body casing; and a downwardly extending plate to take up dust, the downwardly extending plate having a top edge joined to the top mounting section at essentially a right angle, and a bottom edge, said cleaning member being attachable to said main body casing so that said downwardly extending plate extends along a direction perpendicular to a moving direction of said floor cleaner, and said downwardly extending plate includes an overhang along the direction perpendicular to the moving direction of said floor cleaner and protecting outwardly from said main body casing, and a protruding portion protruding downwardly from a lower end of said overhang;

the cleaning member being integrally formed from a soft and flexible material.

6. A cleaning member for cleaning areas near walls and for attachment to a floor cleaner having a main body casing including a bottom, the cleaning member comprising:

a top mounting section for mounting the cleaning member onto a corner of the bottom of the main body casing; and a first downwardly extending plate to take up dust, the first downwardly extending plate having a top edge joined to the top mounting section, and a bottom edge; and wherein the bottom edge of the first downwardly extending plate has a thickened extension over its length to enhance dust take-up by the first downwardly extending plate when the cleaning member is mounted on a corner of the bottom of the floor cleaner and the floor cleaner is moved over a floor in a direction perpendicular to the bottom edge of the first downwardly extending plate;

said cleaning member further comprising a second downwardly extending plate parallel to the first downwardly extending plate, the second downwardly extending plate having a top edge joined to the mounting section, and a bottom edge having a thickened extension over its length.

7. The cleaning member of claim 6 wherein the thickened extensions of the first and second downwardly extending plates extend in opposite directions outwardly from one side of the respective bottom edges, away from one another.

8. The cleaning member of claim 7 wherein the top mounting section has at least a first side, and the first and second downwardly extending plates have, respectively, first and second overhang regions each having bottom edges extending beyond the first side of the top mounting section in a same direction, and the bottom edges of both of the overhang regions include downwardly-directed protrusions to scrape dust from groove-like regions in a carpet.

9. A floor cleaner comprising:

at least one cleaning member of the type of claim 7;

a body casing including a dust collecting chamber and having a bottom having a left and a right side;

a handle extending upward from the body casing for moving the body casing;

a rotatable shaft coupled to the body casing that rotates upon forward and rearward movement of the body casing relative to a surface under the bottom of the body casing;

a rotatable member mounted on the body casing and operatively coupled to the rotatable shaft so that, when the rotatable shaft rotates, dust on a surface below the body casing is transferred by the rotatable member into the dust collecting chamber; and the at least one cleaning member is mounted proximately to at least one of the left and right sides of the body casing so that the downwardly extending plates extend below the bottom of the body casing, wherein the downwardly extending plates frictionally scrape dust from a surface below the dust collecting chamber so that dust so removed is transferred by the rotatable member into the dust collecting chamber.

10. The floor cleaner of claim 9 wherein the bottom edges of the first and second downwardly extending plates are oriented perpendicularly with respect to a direction of movement of the body casing over a floor that causes rotation of the rotatable member.

11. The floor cleaner of claim 9 wherein the at least one cleaning member comprises a plurality of cleaning members, one of which is mounted proximately to the left side and another to the right side of the body casing, on the bottom of the body casing.

12. The cleaning member of claim 6 wherein the top mounting section has at least a first side, and the first and second downwardly extending plates have respective first and second overhang regions each having bottom edges extending beyond the first side of the top mounting section in a same direction, and the bottom edges of both of the overhang regions include downwardly-directed protrusions to scrape dust from groove-like regions in a carpet.

13. A floor cleaner comprising:

at least one cleaning member of the type of claim 12;

a body casing including a dust collecting chamber and having a bottom having a left and a right side;

a handle extending upward from the body casing for moving the body casing;

a rotatable shaft coupled to the body casing that rotates upon forward and rearward movement of the body casing relative to a surface under the bottom of the body casing;

a rotatable member mounted on the body casing and operatively coupled to the rotatable shaft so that, when the rotatable shaft rotates, dust on a surface below the body casing is transferred by the rotatable member into the dust collecting chamber; and the at least one cleaning member is mounted proximately to at least one of the left and right sides of the body casing so that the downwardly extending plates extend below the bottom of the body casing and the bottom edge of the overhang region extends beyond a side of the body casing, wherein the downwardly extending plates frictionally scrape dust from a surface below the dust collecting chamber so that dust so removed is transferred by the rotatable member into the dust collecting chamber.

14. The floor cleaner of claim 13 wherein the bottom edges of the first and second downwardly extending plates are oriented perpendicularly with respect to a direction of movement of the body casing over a floor that causes rotation of the rotatable member.

15. The floor cleaner of claim 13 wherein the at least one cleaning member comprises a plurality of cleaning members, one of which is mounted proximately to the left side and another to the right side of the body casing, on the bottom of the body casing.

16. The floor cleaner of claim 13 wherein the bottom edges of the first and second downwardly extending plates are oriented at an angle of not more than about 15 degrees from perpendicular with respect to a direction of movement of the body casing over a floor causing rotation of the rotatable member.

17. The cleaning member of claim 6 wherein the top mounting section has at least a first side, and the thickened extensions extend in a same direction outwardly from the respective bottom edges of the parallel first and second downwardly extending plates and the first and second downwardly extending plates each include an overhang region extending beyond the first side of the top mounting section.

18. The cleaning member of claim 6 wherein the top mounting section has at least a first side, and the first and second downwardly extending plates each include an overhang region extending beyond the first side of the top mounting section, and the thickened extensions on the parallel first and second parallel downwardly extending plates each have inverted V-shaped cross-sections, the opening of each "V" directed away from the top mounting section.

19. A floor cleaner comprising:

at least one cleaning member of the type of claim 6;

a body casing including a dust collecting chamber and having a bottom having a left and a right side;

a handle extending upward from the body casing for moving the body casing;

a rotatable shaft coupled to the body casing that rotates upon forward and rearward movement of the body casing relative to a surface under the bottom of the body casing;

a rotatable member mounted on the body casing and operatively coupled to the rotatable shaft so that, when the rotatable shaft rotates, dust on a surface below the body casing is transferred by the rotatable member into the dust collecting chamber; and the at least one cleaning member is mounted proximately to at least one of the left and right sides of the body casing so that the downwardly extending plates extend below the bottom of the body casing, wherein the downwardly extending plates frictionally scrape dust from a surface below the dust collecting chamber so that dust so removed is transferred by the rotatable member into the dust collecting chamber.

20. The floor cleaner of claim 19 wherein the bottom edges of the first and second downwardly extending plates are oriented perpendicularly with respect to a direction of movement of the body casing over a floor that causes rotation of the rotatable member.

21. The floor cleaner of claim 19 wherein the at least one cleaning member comprises a plurality of cleaning members, one of which is mounted proximately to the left side and another to the right side of the body casing, on the bottom of the body casing.

22. The floor cleaner of claim 19 wherein the thickened extensions extend in the same direction outwardly from the respective bottom edges of the parallel first and second downwardly extending plates, and the first and second downwardly extending plates each include an overhang region extending beyond a same side of the body casing.

23. The floor cleaner of claim 19 wherein the first and second downwardly extending plates each include an overhang region extending beyond a same side of the body casing, and the thickened extensions of the parallel first and second downwardly extending plates have inverted V-shaped cross-sections, wherein the opening of the "V" is directed away from the top mounting section.

24. A cleaning member for cleaning areas near walls and for attachment to a floor cleaner having a main body casing including a bottom, the cleaning member comprising:

a top mounting section for mounting the cleaning member onto a corner of the bottom of the main body casing; and a first downwardly extending plate to take up dust, the first downwardly extending plate having a top edge joined to the top mounting section, and a bottom edge;

wherein the cleaning member is integrally formed from a soft and flexible material: and wherein the bottom edge of the first downwardly extending plate has a thickened extension over its length to enhance dust take-up by the first downwardly extending plate when the cleaning member is mounted on a corner of the bottom of the floor cleaner and the floor cleaner is moved over a floor In a direction perpendicular to the bottom edge of the first downwardly extending plate;

and also wherein the top mounting section has at least a first side, and the first downwardly extending plate includes a first overhang region having a bottom edge extending beyond the first side of the top mounting section, the bottom edge of the first overhang region including a first downwardly-directed protrusion to scrape dust from groove-like regions in a carpet.

25. The cleaning member of claim 24 wherein the first downwardly extending plate has a tapered thickness between its thickened extension and its top edge so that the first downwardly extending plate is thicker at the top edge than adjacent the thickened extension.

26. A floor cleaner comprising:

at least one cleaning member of the type of claim 24;

a body casing including a dust collecting chamber and having a bottom having a left and a right side;

a handle extending upward from the body casing for moving the body casing;

a rotatable shaft coupled to the body casing that rotates upon forward and rearward movement of the body casing relative to a surface under the bottom of the body casing;

a rotatable member mounted on the body casing and operatively coupled to the rotatable shaft so that, when the rotatable shaft rotates, dust on a surface below the body casing is transferred by the rotatable member into the dust collecting chamber; and the at least one cleaning member is mounted proximately to at least one of the left and right sides of the body casing so that the first downwardly extending plate extends below the bottom of the body casing and the bottom edge of the overhang region extends beyond a side of the body casing, wherein the first downwardly extending plate frictionally scrapes dust from a surface below the dust collecting chamber so that dust so removed is transferred by the rotatable member into the dust collecting chamber.

27. The floor cleaner of claim 26 wherein the bottom edges of the first downwardly extending plate are oriented perpendicularly with respect to a direction of movement of the body casing over a floor that causes rotation of the rotatable member.

28. The floor cleaner of claim 26 wherein the at least one cleaning member comprises a plurality of cleaning members, one of which is mounted proximately to the left side and another to the right side of the body casing, on the bottom of the body casing.

29. A floor cleaner comprising:

a body casing including a dust collecting chamber and having a bottom having a left and a right side;

a handle extending upward from the body casing for moving the body casing;

a rotatable shaft coupled to the body casing that rotates upon forward and rearward movement of the body casing relative to a surface under the bottom of the body casing;

a rotatable member mounted on the body casing and operatively coupled to the rotatable shaft so that, when the rotatable shaft rotates, dust on a surface below the body casing is transferred by the rotatable member into the dust collecting chamber;

at least one cleaning member comprising a top mounting section for mounting the cleaning member onto a corner of the bottom of the body casing; the cleaning member also comprising a first downwardly extending plate to take up dust, the first downwardly extending plate having a top edge joined to the top mounting section at essentially a right angle, the cleaning member also comprising a bottom edge; the cleaning member being integrally formed from a soft and flexible material; and the at least one cleaning member is mounted proximately to at least one of the left and right sides of the body casing so that the downwardly extending plate extends below the bottom of the body casing, wherein the downwardly extending plate frictionally scrapes dust from a surface below the dust collecting chamber so that dust so removed is transferred by the rotatable member into the dust collecting chamber, and further wherein the body casing has at least a first side, and the first downwardly extending plate includes a first overhang region having a bottom edge extending beyond the first side of the body casing.

30. The floor cleaner of claim 29 wherein the bottom edge of the first downwardly extending plate has a thickened extension over its length to enhance dust take-up.

31. The floor cleaner of claim 30 wherein the bottom edge of the first downwardly extending plate is oriented perpendicularly with respect to a direction of movement of the body casing over a floor that causes rotation of the rotatable member.

32. The floor cleaner of claim 29 wherein the bottom edge of the first downwardly extending plate is oriented perpendicularly with respect to a direction of movement of the body casing over a floor that causes rotation of the rotatable member.

33. The floor cleaner of claim 32 wherein the at least one cleaning member comprises a plurality of cleaning members, one of which is mounted proximately to the left side and another to the right side of the body casing, on the bottom of the body casing.

34. The floor cleaner of claim 32 wherein the first downwardly extending plate has a thickened extension at its bottom edge, and a tapered thickness between its thickened extension and its top edge so that the first downwardly extending plate is thicker at its top edge than adjacent its thickened extension.

35. A floor cleaner comprising:

at least one cleaning member having a top mounting section, and a first downwardly extending plate to take up dust, the first downwardly extending plate having a top edge joined to the top mounting section, and a bottom edge;

a body casing including a dust collecting chamber and a bottom having a left and a right side;

a rotatable shaft coupled to the body casing that rotates upon forward and rearward movement of the body casing relative to a surface under the bottom of the body casing; and a rotatable member mounted on the body casing and operatively coupled to the rotatable shaft so that, when the rotatable shaft rotates, dust on a surface below the body casing is transferred by the rotatable member into the dust collecting chamber;

wherein the at least one cleaning member is mounted proximately to at least one of the left and right sides of the body casing so that the downwardly extending plate extends below the bottom of the body casing;

the downwardly extending plate frictionally scrapes dust from a surface below the dust collecting chamber so that dust so removed Is transferred by the rotatable member into the dust collecting chamber; and the bottom edge of the first downwardly extending plate has a thickened extension over its length to enhance dust take-up;

and also wherein said downwardly extending plate includes an overhang along a direction perpendicular to a moving direction of said floor cleaner and projecting outwardly from said main body casing, and a protruding portion protruding downwardly from a lower end of said overhang.

36. The floor cleaner of claim 35 wherein the bottom edge of the first downwardly extending plate is oriented perpendicularly with respect to a direction of movement of the body casing over a floor that causes rotation of the rotatable member.

37. A floor cleaner comprising:

a plurality of cleaning members, each having a top mounting section, and a first downwardly extending plate to take up dust, each first downwardly extending plate having a top edge joined to the top mounting section, and a bottom edge;

a body casing including a dust collecting chamber and a bottom having a left and a right side;

a rotatable shaft coupled to the body casing that rotates upon forward and rearward movement of the body casing relative to a surface under the bottom of the body casing; and a rotatable member mounted on the body casing and operatively coupled to the rotatable shaft so that, when the rotatable shaft rotates, dust on a surface below the body casing is transferred by the rotatable member into the dust collecting chamber;

wherein at least one of the cleaning members is mounted proximately to the left side of the body casing, and at least another one of the cleaning members is mounted proximately to the right side of the body casing so that the downwardly extending plates extend below the bottom of the body casing;

the downwardly extending plates frictionally scrape dust from a surface below the dust collecting chamber so that dust so removed is transferred by the rotatable member into the dust collecting chamber; and the bottom edge of each of the first downwardly extending plates have a thickened extension over its length to enhance dust take-up;

and also wherein said first downwardly extending plate includes an overhang along a direction perpendicular to a moving direction of said floor cleaner and projecting outwardly from said main body casing, and a protruding portion protruding downwardly from a lower end of said overhang.

* * * * *